United States Patent [19]

Collins, Jr.

[11] Patent Number: 4,553,927

[45] Date of Patent: Nov. 19, 1985

[54] IGNITOR PROBE ASSEMBLY AND CERAMIC INSULATOR THEREFOR

[76] Inventor: Raymond L. Collins, Jr., 373 Atterbury Blvd., Hudson, Ohio 44236

[21] Appl. No.: 579,278

[22] Filed: Feb. 13, 1984

[51] Int. Cl.[4] ..... H01T 13/04; F23Q 3/00

[52] U.S. Cl. ..... 431/264; 431/258; 431/261; 431/262; 431/266; 313/118; 313/125; 313/135

[58] Field of Search ..... 431/264, 258, 261, 262, 431/266, 2, 6, 326, 328; 313/118, 125, 135

[56] References Cited

U.S. PATENT DOCUMENTS

| | | | |
|---|---|---|---|
| 2,301,572 | 11/1942 | Nowosielski | 313/135 |
| 2,626,595 | 1/1953 | Berstler | 313/125 |
| 3,050,658 | 8/1962 | Lay et al. | 313/135 |
| 4,082,976 | 4/1978 | Lentz | 313/135 |
| 4,215,979 | 8/1980 | Morishita | 431/264 |
| 4,249,103 | 2/1981 | Farrell | 313/135 |
| 4,433,266 | 2/1984 | Riehl | 431/264 |
| 4,470,799 | 9/1984 | Riggs | 431/264 |

*Primary Examiner*—Samuel Scott

*Assistant Examiner*—Helen A. Odar

*Attorney, Agent, or Firm*—Renner, Kenner, Greive & Bobak

[57] ABSTRACT

An ignitor probe assembly (10) for the ignition of fossil fuel burners comprises in combination an ignitor (11) having a tip (70) activated by electrical energy and producing a temperature sufficient to ignite a fossil fuel, pipe means (12) for positioning the ignitor into the burner, means for carrying electrical power (13) to the ignitor passing through the pipe means adapter means (14) carried by the pipe means for the removable assembly of the ignitor thereto, and refractory insulator means (15) engageable with the means for carrying electrical power and interposed substantially concentrically within the adapter means for maintaining the means for carrying electrical power separate therefrom. A novel insulator (15) comprises a unitary, cylindrical tube (75) of refractory material having a hub (76) of greater external diameter, first (78) and second (79) axial bores passing through the tube and hub respectively, the bores being of different diameters and, a shoulder (80) formed by the intersection of the first and second bores.

7 Claims, 7 Drawing Figures

IGNITOR PROBE ASSEMBLY AND CERAMIC INSULATOR THEREFOR

TECHNICAL FIELD

The present invention is directed toward electric probes of the type employed for igniting the burners of large steam generating vessels, viz., boilers. Such boilers are typically found on large ships but can also be used on land for the generation of heat and/or power. The burner is usually fired by oil which is atomized in the vicinity of the ignitor probe. A short succession of electric discharges from the probe tip causes combustion of the oil which thereafter continues as the oil is fed.

BACKGROUND ART

Typical of electric ignitor probe assemblies are the sparking or discharge type, which require high voltage and fire by charging a capacitor, and the glow plug type which employ high amperage to generate heat. As is known in the art, oil can bring the initial temperature of the boiler into operating ranges relatively quickly after which the boiler can be switched over to a different fuel such as coal.

Irrespective of the fuel, the ignitor must be able to withstand very high temperatures encountered initially by high energy employed for ignition and subsequently, by virtue of being positioned in the midst of the burner flame at least until the boiler operation temperature is reached and in some environments, indefinitely. Boilers of the type contemplated herein are very large dimensionally and hence, the ignitor probe assembly can be positioned ten feet or more into the burner.

As might be expected, the ignitor probe assembly will eventually succumb to the high temperature environment not so much by melting of any components but rather due to the break down of the insulation and subsequent short circuiting. Removal of the ten foot assembly can be a time-consuming task particularly where space for withdrawal is limited. Nor, is disassembly an easy task as the prolonged heat environment tends to bond the engaging components together almost permanently as well as aging and making brittle the electrical wire and its insulation used to carry power to the probe tip.

Assemblies of the type known heretofore for ignition of these burners have employed an insulator comprising cloth, tape, mica and like materials in combination. A primary failure that has been encountered is of the insulator resulting in a short necessitating removal of the assembly, and then the ignitor tip for replacement of the insulator. In time, the wire can be cut back sufficiently or otherwise damaged to the extent that it must also be replaced. Despite the long standing existence of this problem, no ignitor assembly presently known has been able to withstand long periods of use without the failure discussed herein.

DISCLOSURE OF THE INVENTION

It is therefore an object of the present invention to provide an ignitor probe assembly which employs a unique insulator the use of which results in an unexpected improvement in the life of the overall assembly.

It is another object of the present invention to provide an ignitor probe assembly carrying a novel adapter which facilitates connection and removal of conventional ignitor tips which greatly simplifies maintenance when necessary on the assembly.

It is yet another object of the present invention to provide a novel insulator comprising a refractory material which insulator can be employed with ignitor probe assemblies of the type described herein as well as existing assemblies.

These and other objects, together with the advantages thereof over known burner assemblies, which shall become apparent from the specification which follows, are accomplished by the invention as hereinafter described and claimed.

In general, the ignitor probe assembly of the present invention comprises in combination an ignitor having a tip activated by electrical energy and producing a temperature sufficient to ignite a fossil fuel, pipe means for positioning the ignitor into the burner, means for carrying electrical power to the ignitor passing through the pipe means, adapter means carried by the pipe means for the removal assembly of the ignitor thereto and refractory insulator means engageable with the means for carrying electrical power and interposed substantially concentrically within the adapter means for maintaining the means for carrying electrical power separate therefrom.

A novel insulator is also provided which comprises a unitary, cylindrical tube of refractory material having a hub of greater external diameter, first and second axial bores passing through the tube and hub respectively, the bores being of different diameters and, a shoulder formed by the intersection of the first and second bores. The insulator is particularly designed so that the second bore is adapted to receive the end of an insulated wire, the insulating abutting against the shoulder whereby a segment of bared wire is presented into the second bore. Also the first bore houses a metal connector affixed to the bared wire and engageable with a mating plug from an electrical device such as an ignitor probe.

PREFERRED MODE FOR CARRYING OUT THE INVENTION

Figure 4:
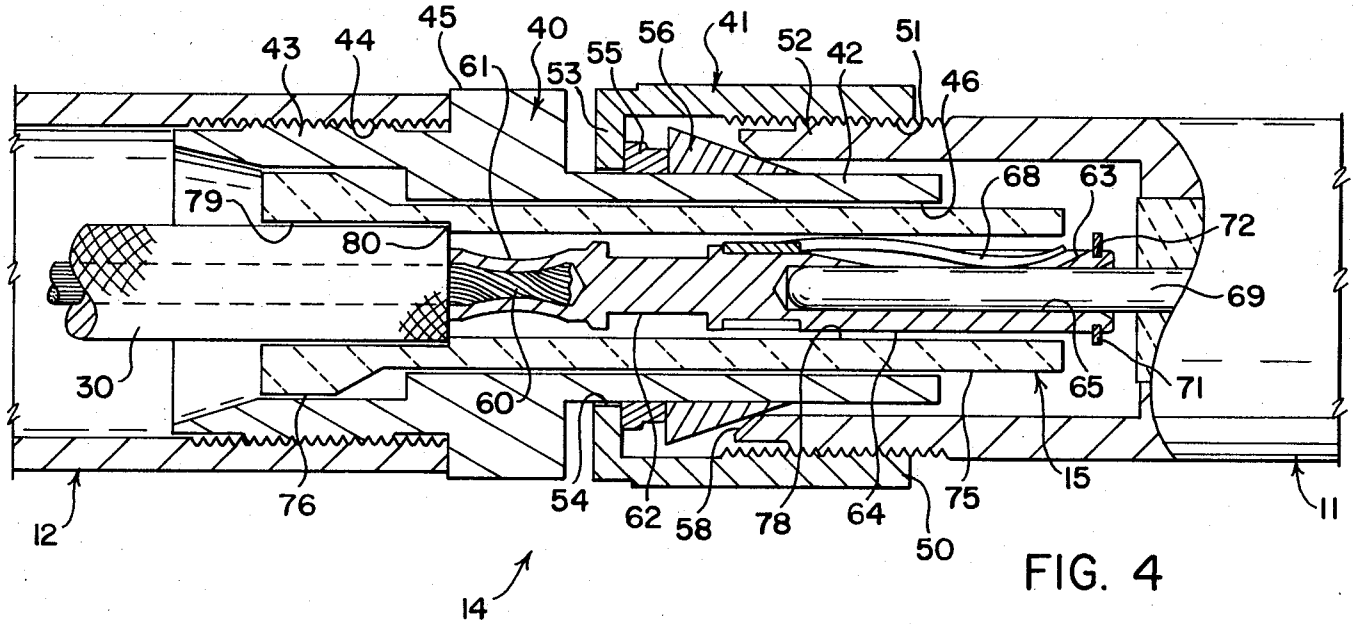
FIG. 4 is an enlarged view, partially in section, of the adapter and novel insulator of the present invention.
Figure 5:
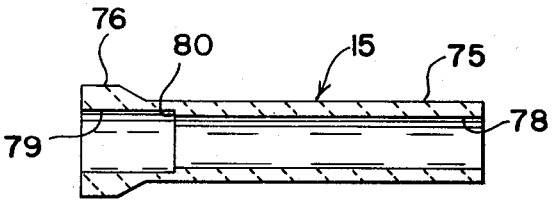
FIG. 5 is a side elevation in cross-section of the novel insulator alone.

The ignitor probe assembly of the present invention is depicted generally by the numeral 10. The assembly 10 basically comprises an ignitor 11, an elongate shaft or pipe 12 carrying the ignitor 11, means for carrying electrical power to the ignitor, depicted generally by the numeral 13, adapter means 14, interconnecting the ignitor 11 with the pipe 12 and an insulator means 15 (FIGS. 4 and 5).

The pipe 12 is relatively long in order to position the ignitor 11 well into a burner. It is preferably constructed of ½ inch (1.25 cm) stainless steel pipe and can be about 3 to 9 feet (1 to 3 meters) long or whatever length is necessary. While the material and dimensions are not limitations on the present invention, stainless steel is selected as it will withstand the environment better, that is, it will resist oxidation which subsequently hinders threading operations necessitated during disassembly and reassembly. The diameter should be as small as possible for weight and cost considerations so long as the pipe provides sufficient rigidity for the assembly.

Figure 1:
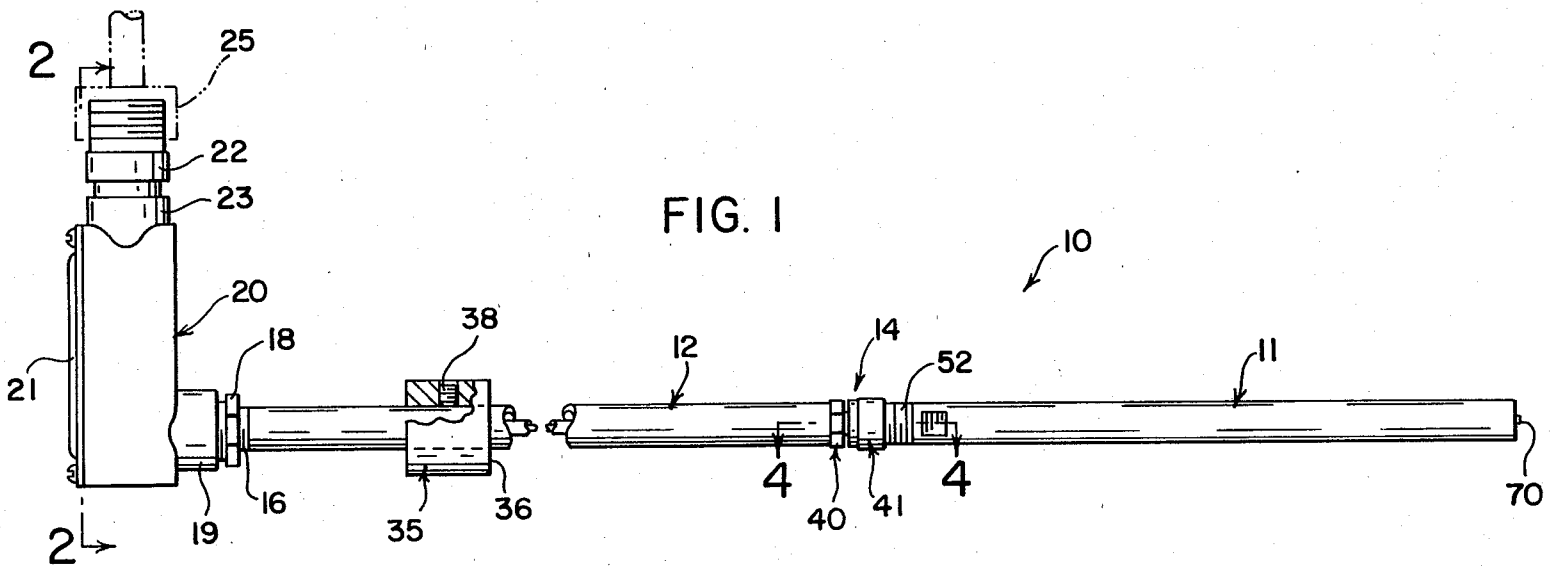
FIG. 1 is an overall elevation of the ignitor probe assembly of the present invention with portions broken away for detail and to allow presentation of both ends in one view.
Figure 2:
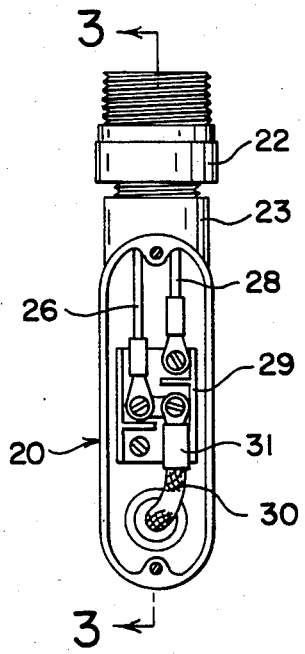
FIG. 2 is a rear elevation, taken substantially along line 2—2 of FIG. 1, depicting a wiring arrangement for the ignitor tip.
Figure 3:
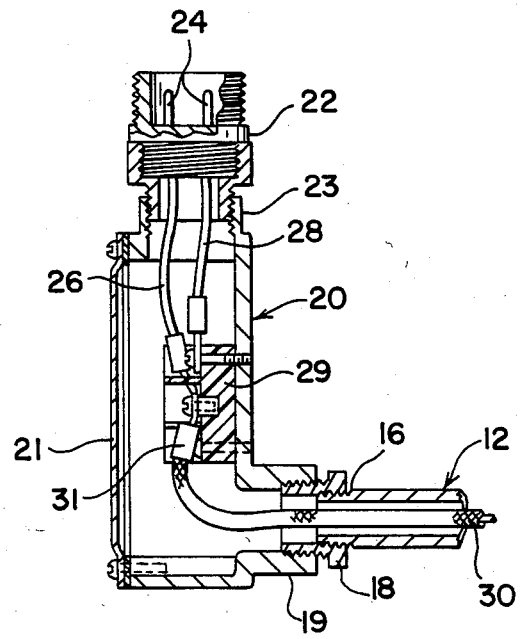
FIG. 3 is a cross-sectional view, taken substantially along line 3—3 of FIG. 2, further depicting the wiring arrangement.

The pipe 12 is threaded at its inboard end 16 and is connected by a reducer 18 to the base 19 of an electrical elbow 20. The elbow 20 is somewhat modified for use in the assembly 10 but is not otherwise a necessary component thereof, as the pipe could be bent or provided with other means for connecting the necessary electrical wiring. With reference to FIGS. 2 and 3, it is seen that the elbow 20 carries a removable cover plate 21 which would face the operator when the assembly is positioned within a burner. A plug connector 22 threadably engages the neck 23 of elbow 20 and provides conventional male prongs 24 for connection to a plug 25. Two wires 26 and 28 pass from the prongs 24 to a terminal block 29 carried by the rear wall of the elbow 20. Wire 26 carries power to the block 29 while wire 28 is a ground. A high temperature wire 30, is connected to the terminal 29 via ring lug 31 to carry power to the ignitor 12 as will be explained hereinbelow.

A stop 35 is provided on the pipe 12 to limit the depth of insertion of the assembly 10 into a burner. This is useful as the overall assembly is generally inserted through a hole in a wall or panel and precise location of the ignitor tip 12 cannot otherwise be readily determined. The stop 35 comprises an enlarged block carried at the end proximal the elbow 20. The block 36 has a forward face or shoulder 36 engageable with the wall or panel (not shown) that would house the burner. The stop 35 can be adjustably or permanently affixed to the pipe 12 in any known suitable manner, such as set screw 38 for adjustability, whereby the shoulder 36 forms a register for the measurement of a predetermined location for the ignitor tip.

Figures 6, 7:
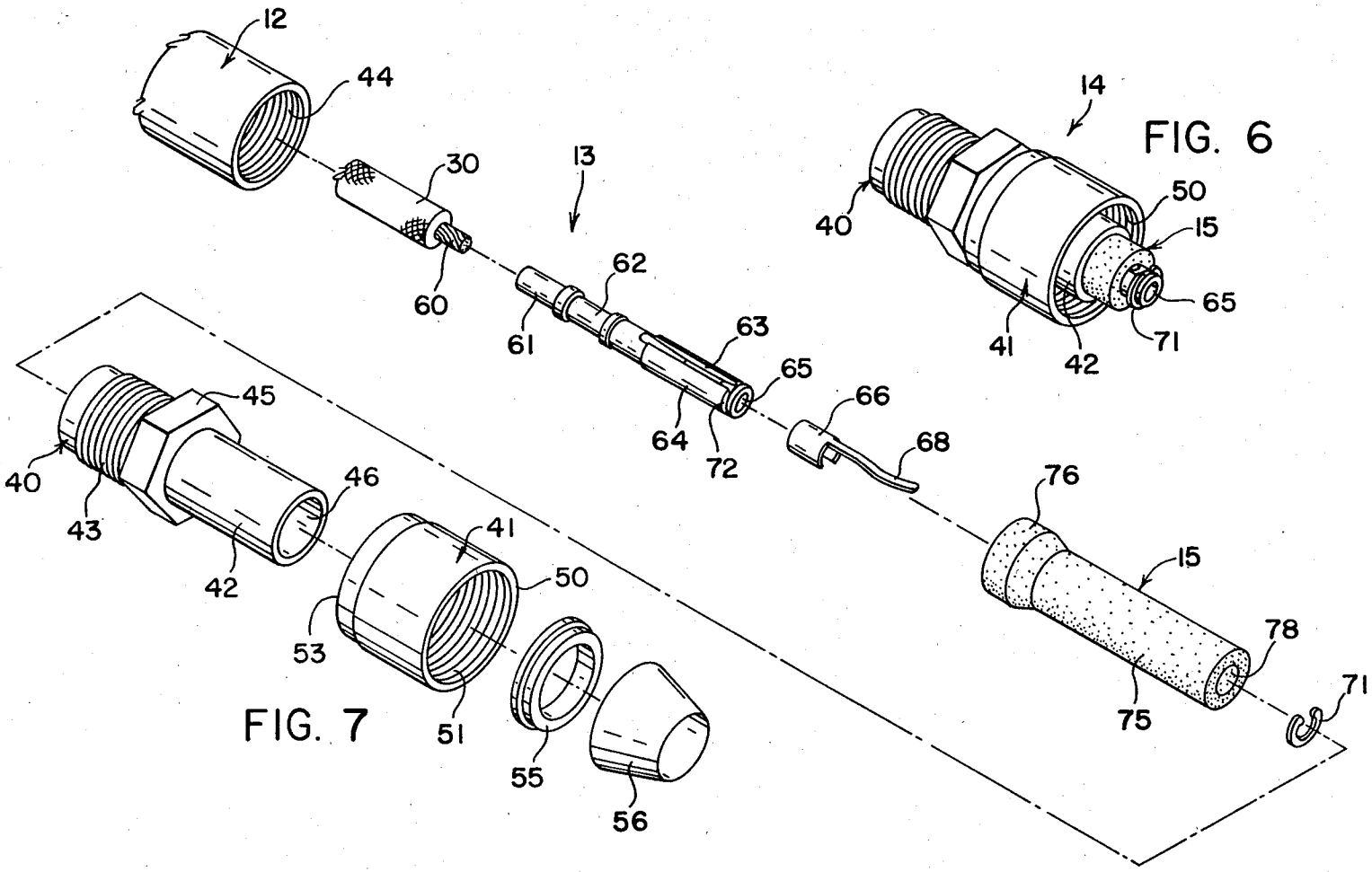
FIG. 6 is a perspective view of the adapter and novel insulator assembled together.
FIG. 7 is an exploded perspective view depicting the assembly of the adapter and component parts thereof in conjunction with the novel insulator and an element of the overall assembly to which the adapter is mounted.

With reference next to FIGS. 6 and 7, the detail and assembly of the adapter means 14 shall be discussed. The adapter 14 comprises first and second fitting members 40 and 41, respectively. Fitting member 40 in turn has a barrel 42, a base 43 carrying external threads engageable with the threaded end 44 of pipe 12, and a hex nut 45 with rounded points. As best depicted in FIG. 4, the fitting member 40 has an internal bore 46 which houses the insulator means 15.

Fitting member 41 is an element most similar to a gland nut of a valve. It carries at its mouth 50 a set of internal threads 51 engageable with the threaded end 52 of ignitor 11. Opposite the mouth 50 is a back wall 53, having a hole 54 just slightly larger than the diameter of barrel 42 so as to be freely rotatable therearound. The adapter 14 also carries rear and front ferrules 55 and 56, respectively, which fit within member 41 and onto the barrel 42. During assembly, the ferrules 55 and 56 are swaged onto the barrel 42 in a suitable manner thereby permanently affixing member 41 as a component of the adapter means 14 while allowing it to remain freely rotatable around the barrel 42.

Thus, the adapter means 14 is comparable to a Swagelock fitting, Swagelock being a registered trademark of Crawford Fitting Company. The individual components of adapter means 14 are all preferably of corrosion resistant alloys such as Inconel, a registered trademark of The International Nickel Co., Inc., for nickel, iron and chromium alloys. The use of this metal alloy insures compatibility with the ignitor 11 which is customarily also manufactured from Inconel. With reference again to FIG. 4, it will be noted that identical metal interfaces or contacts occur between the ignitor at end 52, the threads 51 of fitting member 41 and ferrule 56. Ferrule 56, in turn, is in contact with ferrule 55 and barrel 42. The effect of this selection of materials and their respective design insures that corrosion will not occur and that the disassembly of the ignitor 11 from the adapter 14 will be possible even after long periods of use in the burner environment.

It will also be noted that fitting member 41 does not carry external face, hexagonal or otherwise, for the application of a wrench. A bevel 58 at the end 52 of the ignitor 11 engages the ramped surface of ferrule 56, generally locking the end against the threads 51 of member 41. By hand tightening or using channel locks for assembly, member 41 is far more likely to be disengageable from the ignitor 11. While the pipe 12 is not also Inconel, if it is at least a compatible material such as stainless steel, corrosion will also be minimized should dissassembly of fitting member 40 be desired.

The upper half of FIG. 7 depicts the assembly of the means for carrying power 13. It includes the insulated wire 30 which has been passed through pipe 12 from elbow 20. The wire 30 is bared at 60 so that the base 61 of a connector 62 can be crimped thereto (FIG. 4). The connector 62 is provided with an elongate slot 63 along a portion of the sidewall 64 which communicates with a recess 65 at the other end of the connector 62. A spring clip 66 is positioned on the connector 62 and presents a finger 68 into the slot 63 and recess 65.

In FIG. 4, the male prong 69 from the ignitor 11 is received in the recess 65 during assembly and carries the power from means 13 to the tip 70 of the ignitor where a spark is generated to ignite the burner. Before the assembly is completed however, the refractory insulator 15 of the present invention is positioned over the connector 62 and a short section of the wire 30. It is held around the connector by a retainer clip 71 slipped into a recess at the end 72 of connector 62. The insulator 15 insures that no portion of the wire 31, connector 62 or prong 69 can ever contact the adapter 14 or base end 52 of the ignitor 11 which is connected to ground and would immediately short circuit the assembly 10. Existing assemblies prior to the present invention have not utilized a rigid insulator 15 but have instead employed insulation comprising layers of tape, mica and other known materials which are wrapped around the connector, wire and prong. These deteriorate rather quickly in the burner environment and hence life of the assembly may not exceed more than several months before a short occurs necessitating a possible shutdown and certain removal and disassembly operations.

The insulator 15 is preferably manufactured from a refractory material such as a ceramic to withstand the high heat and voltages. It comprises a hollow tube 75 having a hub or base 76. The internal diameter of the tube bore 78 is sufficient to receive the connector 62. At the base 76, the internal diameter of a second bore 79 is slightly larger in order to accommodate the insulation of the wire 30 which abuts against a shoulder 80 formed at the juncture of bores 78 and 79. The base 76 is also of suitable external dimension to fit within the base of adapter 43 while the external diameter of the tube 75 is such that is fits concentrically within the reducer tube 42.

Thus, is should be clear to those skilled in the art the manner in which the assembly 10 is constructed, assembled and used. It should also be clear that the insulator 15 is a novel element of the overall assembly 10.

Based upon the foregoing disclosure, it should now be apparent that the use of the assembly described herein will carry out the objects set forth hereinabove. It should also be apparent to those skilled in the art that the assembly of the subject invention can readily be utilized in conjunction with various types of burners and that the component elements should be constructed from corrosion-resistant materials. It is to be understood that any variations evident fall within the scope of the claimed invention; therefore, the selection of specific materials and component elements can be determined without departing from the spirit of the invention herein disclosed and described. Moreover, the scope of the invention shall include all modifications and variations that may fall within the scope of the attached claims.

I claim:

1. An assembly for removably installing an electric ignitor probe within a burner comprising:

pipe means for positioning the ignitor into the burner, said pipe means having a threaded end;

first fitting means having a bore extending axially therethrough, a first end with threads matingly engaging said threaded end of said pipe means, a second and cylindrically configured, nut means interposed between said first and second ends for rotatively manipulating said first fitting means relative to said pipe means;

second fitting means having a mouth providing internal threads engageable with one end of the ignitor probe and a back wall having an aperture therein concentric with said internal threads for receipt of said second end of said first fitting means;

means for rotatably securing said second fitting means to said second end of said first fitting means and positioning said second end substantially concentrically within said mouth of said second fitting means; and ferrule means affixed to said second end of said first fitting means, positioned within said mouth of said second fitting means and engageable with said end of the ignitor probe when the latter is threadably engaged with said second fitting means.

2. An assembly, as set forth in claim 1, further comprising:

means for carrying electrical power to the ignitor probe, said means passing through said pipe means; and refractory insulator means interposed concentrically within said bore of said first fitting means for maintaining said means for carrying electrical power electrically distinct therefrom.

3. An assembly, as set forth in claim 2, wherein said refractory insulator means comprises:

a unitary, cyclindrical tube having a hub of greater internal diameter;

a first bore passing through said insulator means;

a second bore, of greater diameter than said first bore and positioned coaxially therewith, passing through said insulator in the vicinity of said hub and intersecting said first bore; and, a shoulder formed by the intersection of said first and second bores.

4. An assembly, as set forth in claim 3, wherein said means for carrying electrical power comprises:

a length of insulated wire extending partially into said first fitting means; and connector means engageable with one end of the ignitor probe and affixed to one end of said wire.

5. An assembly, as set forth in claim 4, wherein said second bore is adapted to receive the end of said insulated wire, the insulation abutting against said shoulder whereby a segment of bared wire is presented into said first bore;

and wherein said first bore houses said connector means.

6. An assembly, as set forth in claim 5, further comprising:

stop means carried by said pipe means for physically positioning the ignitor probe at a predetermined location beneath said burner.

7. An assembly, as set forth in claim 6, wherein said stop means comprises:

a block positioned along said pipe means furthest from the ignitor presenting a forward shoulder which forms a register against which said predetermined location is measured when said stop means is rigidly affixed to said pipe means.

* * * * *